US007228899B2

(12) United States Patent
Newman et al.

(10) Patent No.: US 7,228,899 B2
(45) Date of Patent: Jun. 12, 2007

(54) WARNING DEVICE AND METHOD TO PREVENT CLUTCH BURNING

(75) Inventors: Frederic M. Newman, Midland, TX (US); Kevin Northcutt, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 99 days.

(21) Appl. No.: 10/778,846

(22) Filed: Feb. 13, 2004

(65) Prior Publication Data

US 2004/0188088 A1 Sep. 30, 2004

Related U.S. Application Data

(60) Provisional application No. 60/447,342, filed on Feb. 14, 2003.

(51) Int. Cl.
*E21B 19/08* (2006.01)

(52) U.S. Cl. ..... 166/250.01; 166/77.1; 175/27; 175/162; 73/118.1; 73/152.51; 173/11; 173/178; 173/180

(58) Field of Classification Search ..... 166/250.01, 166/250.15, 53, 77.1; 175/27, 162; 702/9; 73/118.1, 152.51; 192/85 R; 173/4, 11, 173/178, 180; 254/903
See application file for complete search history.

(56) References Cited

U.S. PATENT DOCUMENTS

| | | | | |
|---|---|---|---|---|
| 4,324,387 | A | 4/1982 | Steinhagen | 254/310 |
| 4,444,273 | A * | 4/1984 | Ruby | 173/180 |
| 4,662,608 | A | 5/1987 | Ball | 254/273 |
| 4,875,530 | A | 10/1989 | Frink et al. | 175/27 |
| 5,713,422 | A | 2/1998 | Chindsa | 175/27 |
| 6,003,598 | A * | 12/1999 | Andreychuk | 166/77.1 |
| 6,079,490 | A | 6/2000 | Newman | 166/77.51 |
| 6,164,493 | A | 12/2000 | Shelton, Jr. | 222/1 |
| 6,168,054 | B1 | 1/2001 | Shelton, Jr. | 222/608 |
| 6,186,248 | B1 | 2/2001 | Silay et al. | 175/27 |
| 6,209,639 | B1 | 4/2001 | Newman | 166/250.01 |
| 6,212,763 | B1 | 4/2001 | Newman | 29/702 |
| 6,213,207 | B1 | 4/2001 | Newman | 166/250.01 |
| 6,241,020 | B1 | 6/2001 | Newman | 166/250.01 |
| 6,253,849 | B1 | 7/2001 | Newman | 166/255.1 |
| 6,276,449 | B1 * | 8/2001 | Newman | 166/53 |
| 6,374,706 | B1 | 4/2002 | Newman | 81/57.34 |
| 6,377,189 | B1 | 4/2002 | Newman | 340/854.6 |
| 2002/0156582 | A1 | 10/2002 | Newman | 702/5 |

(Continued)

OTHER PUBLICATIONS

International Search Report, mailed Aug. 9, 2004. PCT Application Serial No. PCT/US2004/004411, filed Feb. 13, 2004.

*Primary Examiner*—David Bagnell
*Assistant Examiner*—Matthew J. Smith
(74) *Attorney, Agent, or Firm*—King & Spalding, LLP

(57) ABSTRACT

This invention is generally directed towards a system designed to assist the rig operator by alerting him/her that the air pressure is too low to be using the drum clutch, to provide a log for studies on rig operation technique, and to provide a training tool for rig operators. If the pressure on the clutch bladder is above a predetermined range, the clutch is allowed to engage. If the signal is below the range, the clutch is assumed to have not been engaged. If the signal is within the range, the clutch is not allowed to engage and the rig operator is notified of the problem.

32 Claims, 5 Drawing Sheets

U.S. PATENT DOCUMENTS

2002/0156591 A1 10/2002 Newman ..... 702/45
2002/0156670 A1 10/2002 Newman ..... 705/9
2002/0156730 A1 10/2002 Newman ..... 705/40
2003/0042020 A1 3/2003 Newman ..... 166/250.15

* cited by examiner

Figure 3 of "A Warning Device to Prevent Clutch Burning on a Well Service Rig.

WARNING DEVICE AND METHOD TO PREVENT CLUTCH BURNING

BACKGROUND OF THE INVENTION

After an oil rig drills a well and installs the well casing, the rig is dismantled and removed from the site. From that point on, a mobile repair unit is typically used to service the well. Servicing includes installing and removing inner tubing strings, sucker rods, and pumps. The variety of work requires a myriad of tools.

One piece of equipment that is found on almost every well service rig is a hoist system for controlling the movement of a cable attached to a traveling block. The hoist winds and unwinds a cable that is attached to a traveling block, which is ultimately used to raise and lower heavy objects, such as rods and tubing, into and out of oil and gas wells. The hoist is usually driven by a variable speed engine coupled in part to the hoist. The prime mover (engine) drives the hoist, usually utilizing a chain driven compound and an air actuated friction clutch, the drum clutch being a critical component of the overall hoist system. The clutch is frequently the most often abused component of the overall drum system. For the most part, the abuse comes from unwanted slippage, which leads to excessive wear on the clutch assembly, leading to a reduced load size the well service rig can lift, and ultimately leading to a total breakdown of the rig.

The coupling effect of a clutch is a function of both the frictional component of the clutch (coefficient of friction and cross sectional area) and the total force between the drum and the compound plates. Naturally, higher hook loads supported by the well service rig require increased coupling between the compound and the drum, thereby requiring a stronger clutch. Since well service rig clutches are commonly air actuated, the amount of air pressure being exerted on the clutch assembly is critical to it operating properly.

The life of a drum clutch on a well service rig varies in accordance to usage and operator technique. On some rigs, clutches can last over 5 years, while on others they are replaced at intervals less than 1 year. This leads to costly rig repairs and even costlier rig down time. Therefore, this industry needs a system to assist the rig operator in operating the drum clutch so as to reduce the wear on the clutch caused by operator technique.

SUMMARY OF THE INVENTION

This invention is generally directed towards a system designed to assist the drilling rig or well service rig operator by alerting him/her that the air pressure is too low to be using the drum clutch, to provide a log for studies on rig operation technique, to provide a training tool for rig operators, and to assist in controlling the rig operation. A pressure sensor transducer is mounted near the clutch air supply line going into the clutch bladder so that it can monitor the actual air pressure to the clutch. This transducer sends its signal to a logic circuit which compares the signal to a predetermined value range. If the signal is above this range, the logic circuit assumes the clutch is engaged and that there is sufficient air pressure to lift the load. If the signal is below the range, the logic circuit assumes the clutch has not been engaged and the drum is not lifting. If the signal is within the range, the circuit assumes the clutch is engaged, but the air pressure is too low to accommodate the load. The logic circuit then sends and alarm to the operator, notifying him/her of the problem.

DESCRIPTION OF ILLUSTRATIVE EMBODIMENTS

Figure 1:
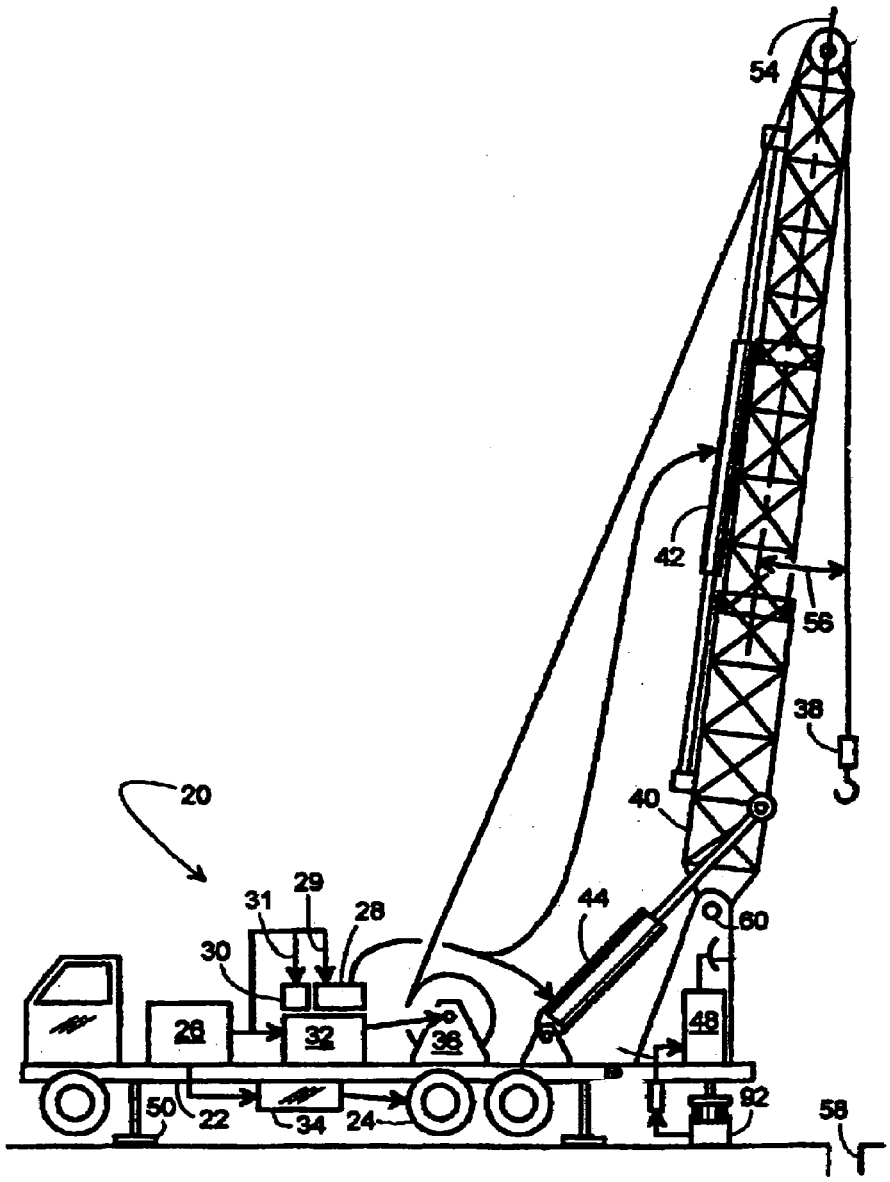
FIG. 1 illustrate the basic components of a well service rig.

Referring to FIG. 1, a retractable, self-contained workover rig 20 is shown to include a truck frame 22 supported on wheels 24, an engine 26, an hydraulic pump 28, an air compressor 30, a first transmission 32, a second transmission 34, a variable speed hoist 36, a block 38, an extendible derrick 40, a first hydraulic cylinder 42, a second hydraulic cylinder 44, a monitor 48, and retractable feet 50. Engine 26 selectively couples to wheels 24 and hoist 36 by way of transmissions 34 and 32, respectively. Engine 26 also drives hydraulic pump 28 via line 29 and air compressor 30 via line 31. Air compressor 30 powers a pneumatic slip (not shown), and hydraulic pump 28 powers a set of hydraulic tongs (not shown). Hydraulic pump 28 also powers hydraulic cylinders 42 and 44 that respectively extend and pivot derrick 40 to selectively place derrick 40 in a working position (FIG. 1) and in a retracted position (not shown). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments, such as inner pipe strings and/or sucker rods. working position (FIG. 1) and in a retracted position (not shown). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments, such as inner pipe strings 62 and/or sucker rods.

Referring back to FIG. 1, weight applied to block 38 is sensed, for example, by way of a hydraulic pad 92 that supports the weight of derrick 40. Generally, hydraulic pad 92 is a piston within a cylinder, but can alternatively constitute a diaphragm. Hydraulic pressure in pad 92 increases with increasing weight on block 38, and this pressure can accordingly be monitored to assess the weight of the block. Other types of sensors can be used to determine the weight on the block, including line indicators attached to a deadline of the hoist, a strain gage that measures any compressive forces on the derrick, or load cells placed at various positions on the derrick or on the crown. While the weight of the block can be measured in any number of ways, the exact means of measurement is not critical to the present invention, however it is important that the weight on the block is measured.

The engine 26 is typically rated at or above 300 horsepower, and is connected to an automatic transmission 32, which usually consists of 5 or 6 gears. The automatic transmission 32 is connected to a right angle drive that moves a compound of chains and sprockets, which in turn drive the tubing drum clutch via a series of sprockets. When an operator desires to pick up a load and pull it out of the hole, the clutch is engaged between the drum and the compound output plate by applying air pressure. Frictional force then transfers the rotating energy from the compound to the tubing drum. As the drum rotates, it spools up or releases the drilling line, which in turn causes the traveling blocks to move up or down, respectively, lifting or lowering the load out of the hole.

The objective is to transfer power from the engine directly to the tubing drum without undue wear and tear on moving parts as well as minimum loss of energy or speed. The engine is running at all times during the rig operation, and this turning energy is transferred to the compound via the torque converter, transmission, right angle drive, and compound. The power train design is intended for the torque converter to take all the slippage, keeping slippage on the drum clutch to a minimum.

Figure 2:
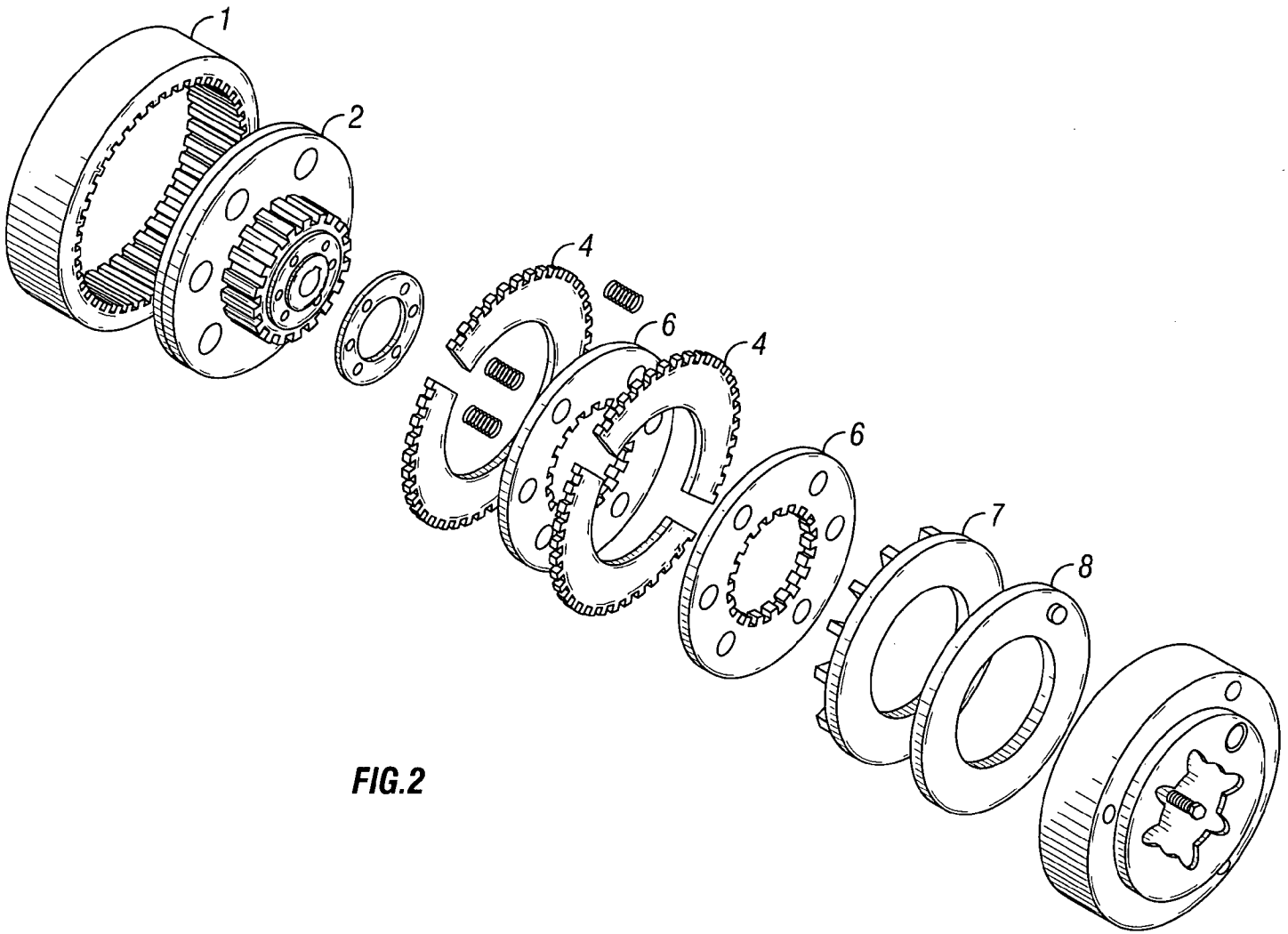
FIG. 2 shows the basic parts of a drum clutch.

Referring to FIG. 2, a generic overview of the basic component parts of a clutch are shown, however it should be noted that there are many different clutch designs, but all work with friction. Air pressure is applied to rubber bladder 8 which forces pressure plates 7 and 6 to compress clutch friction disks 4 into plate 2, thereby causing the rotary motion of the compound to be transferred to the driving ring 1 which moves the hoist. The friction coupling force is represented by the following equation 1:

$$F=N*f \qquad \text{Eq. 1}$$

Where F is the total frictional force between two objects, f is the coefficient of friction, and N is the normal pressure between the two objects. In this case, the two objects are the pressure plates 7 and 6 and the plate 2, with the friction disks 4 providing the friction. In the case of the clutch shown in FIG. 2, the normal force can be expressed by equation 2 below:

$$N=A*P \qquad \text{Eq. 2}$$

Where A is the cross sectional area of the bladder 8 and P is the air pressure applied to the bladder. Therefore, the ultimate frictional coupling force is directly dependent upon air pressure applied to the bladder 8, making it apparent that any reduction in air pressure to the clutch causes a reduced coupling force between the compound and the tubing drum.

When heavy loads are being lifted, slippage can occur, so therefore it is incumbent on the rig operator to have every assurance that the maximum air pressure is being applied to bladder 8, or, in the alternative, at least the minimum pressure necessary to lift the load without clutch slippage. There are numerous causes that might cause the air pressure on bladder 8 to fall below an optimum value. Such causes may be low air compressor output, leakage in the air supply lines, restricted air supply lines, and/or leakage in bladder 8. Ideally the clutch engagement would only occur when the maximum amount of air is applied to the bladder, however limiting engagement to when the air pressure is only at is maximum is impractical in the real world, as this could prohibit clutch use in certain situations that could ultimately cause a safety hazard.

Figure 3:
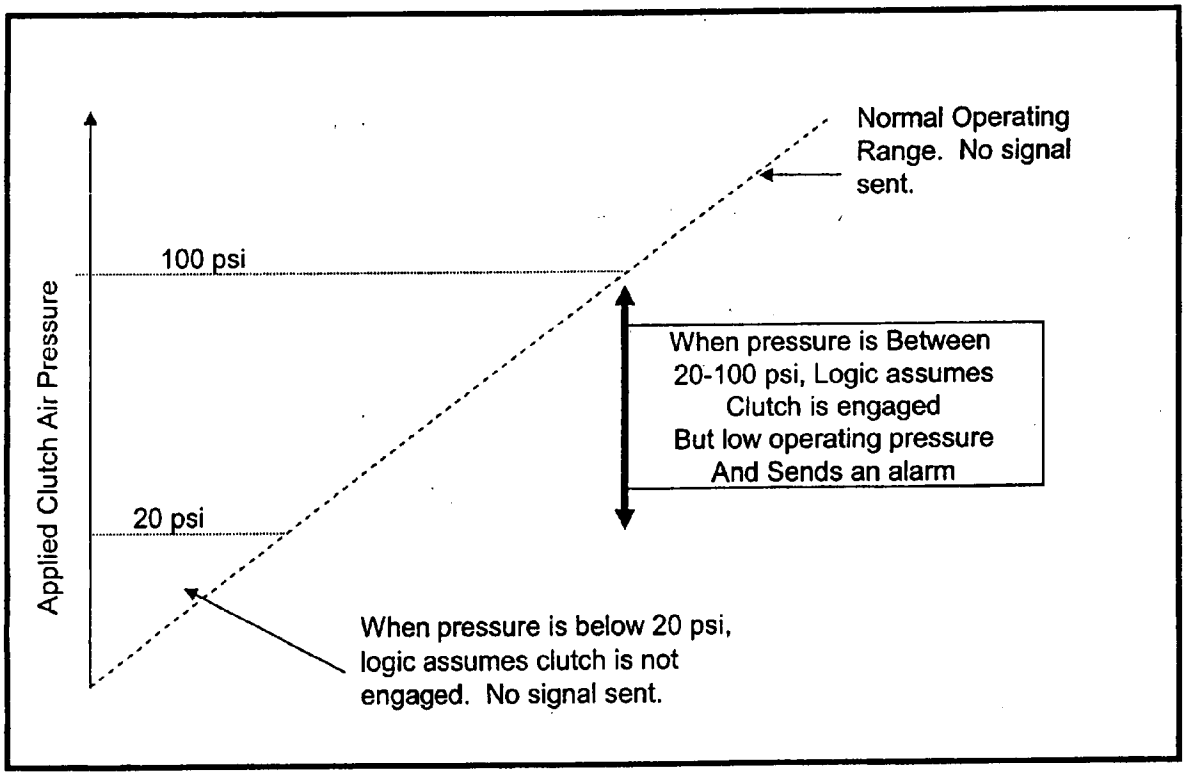
FIG. 3 graphically illustrates one embodiment of the present invention.

In lieu of limiting clutch engagement to situations in which the air pressure is at a maximum value, an air pressure range is used. A service rig clutch system is usually designed to operate at a specified air pressure, but for example purposes it will be assumed that that specified air pressure for proper operation is at least 100 psi, although this pressure can vary from rig to rig. Therefore, based on the example of 100 psi, a range is used to determine when the operator can engage the clutch. For instance, using a range of 20-100 psi, if the air pressure on the clutch is below 20 psi, it is assumed that the clutch is not engaged, and therefore the operator need not be notified of the low clutch air pressure. If the air pressure is above 100 psi, it is assumed that the clutch is engaged, and there is enough air pressure to accommodate the load. If the air pressure is within the 20-100 psi range, it is assumed that the clutch is engaged, however there is not enough air pressure to lift the load. In this instance, an alarm or other means of notifying the operator is activated to let him/her know that the rig is not operating at an optimum condition. FIG. 3 graphically illustrated this range.

This is accomplished by tying in a pressure transducer to the air supply line going directly into bladder 8. This transducer sends a signal to a logic circuit, which is preprogrammed with the desired air pressure range. The logic circuit looks at the transducer pressure reading and compares it to the predetermined air pressure range (e.g. 20-100 psi). As described above, when the pressure signal is below the range (e.g. 20 psi), the logic circuit takes no action, as it is assumed that the clutch is not engaged. If the signal is above the range (e.g. 100 psi), the logic signal takes no action, as it assumes the clutch is engaged and that there is sufficient air pressure on the clutch. Finally, if the signal is within the range (e.g. 20-100 psi), the logic circuit assumes the clutch is engaged, but the applied air pressure is below a minimum value (e.g. 100 psi) for minimizing clutch slippage. The logic circuit then sends an alarm to the operator notifying him/her of the potential problem. This alarm can consist of any suitable means of notifying the operator, and may include a light, horn, or buzzer.

Figure 4:
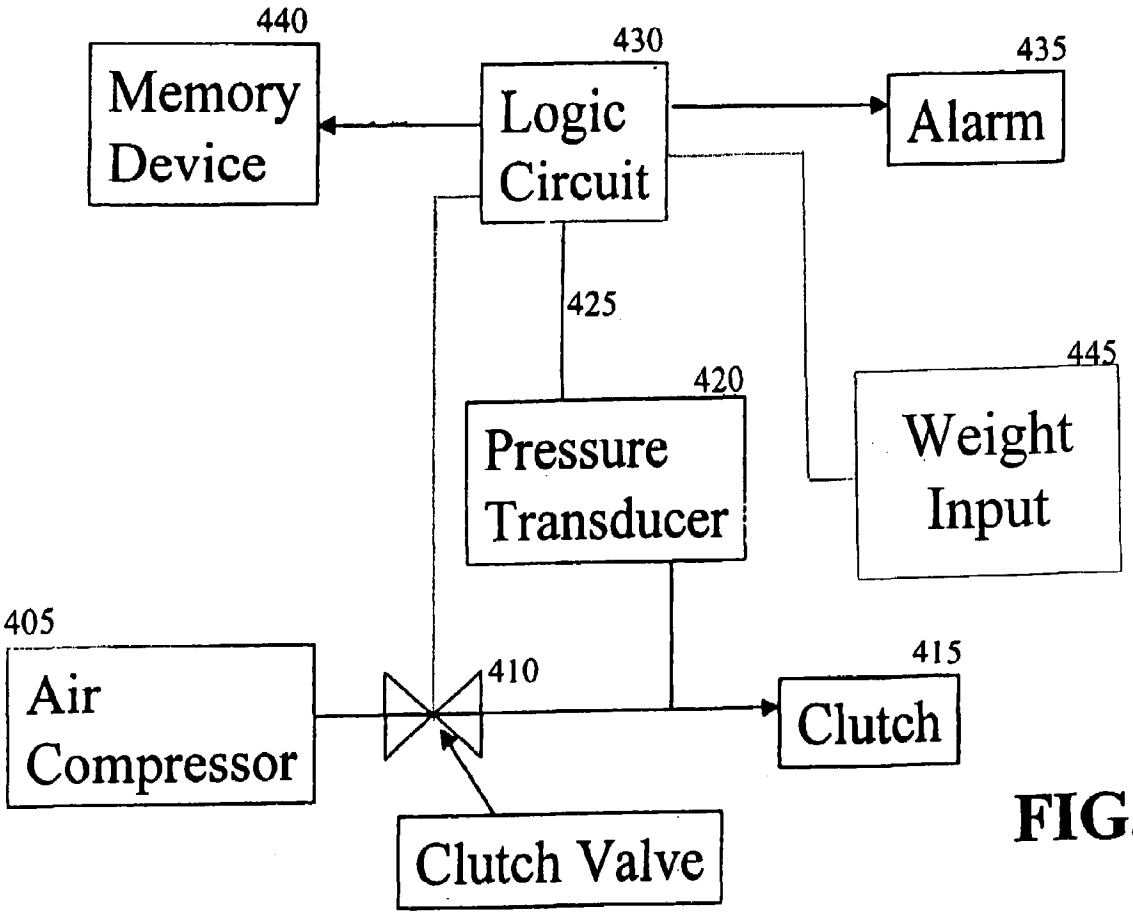
FIG. 4 shows a schematic of one embodiment of the present invention.

Referring to FIG. 4, a schematic drawing of the present invention is shown. Air compressor 405 supplies air via line 410 to clutch 415. Pressure transducer 420 monitors the air pressure on line 410, and reports the pressure reading 425 to logic circuit 430. Logic circuit 430 compares the pressure reading 425 to the predetermined range, and if it falls within the range, it 430 activates alarm 435. Alternatively, the logic circuit 430 can record the pressure in memory device 440.

In an alternative embodiment, when the air pressure is within the predetermined range, the logic circuit records a pulse signal in a data storage device, including, for example, a computer, data recorder, CREW box storage device, or other storage device. This pulse signal indicates the number of times the clutch was engaged and operated at a point other than at or above the minimum acceptable value. In a further embodiment, the logic circuit continuously records the pressure signal in a memory storage device, and could even display the instantaneous or historical pressure to the operator. By recording the pressure on the clutch or monitoring the number of instances at which the clutch was engaged at less than optimum pressure, the rig supervisor or other person can critique and train the rig operator on proper clutch operation.

Figure 5:
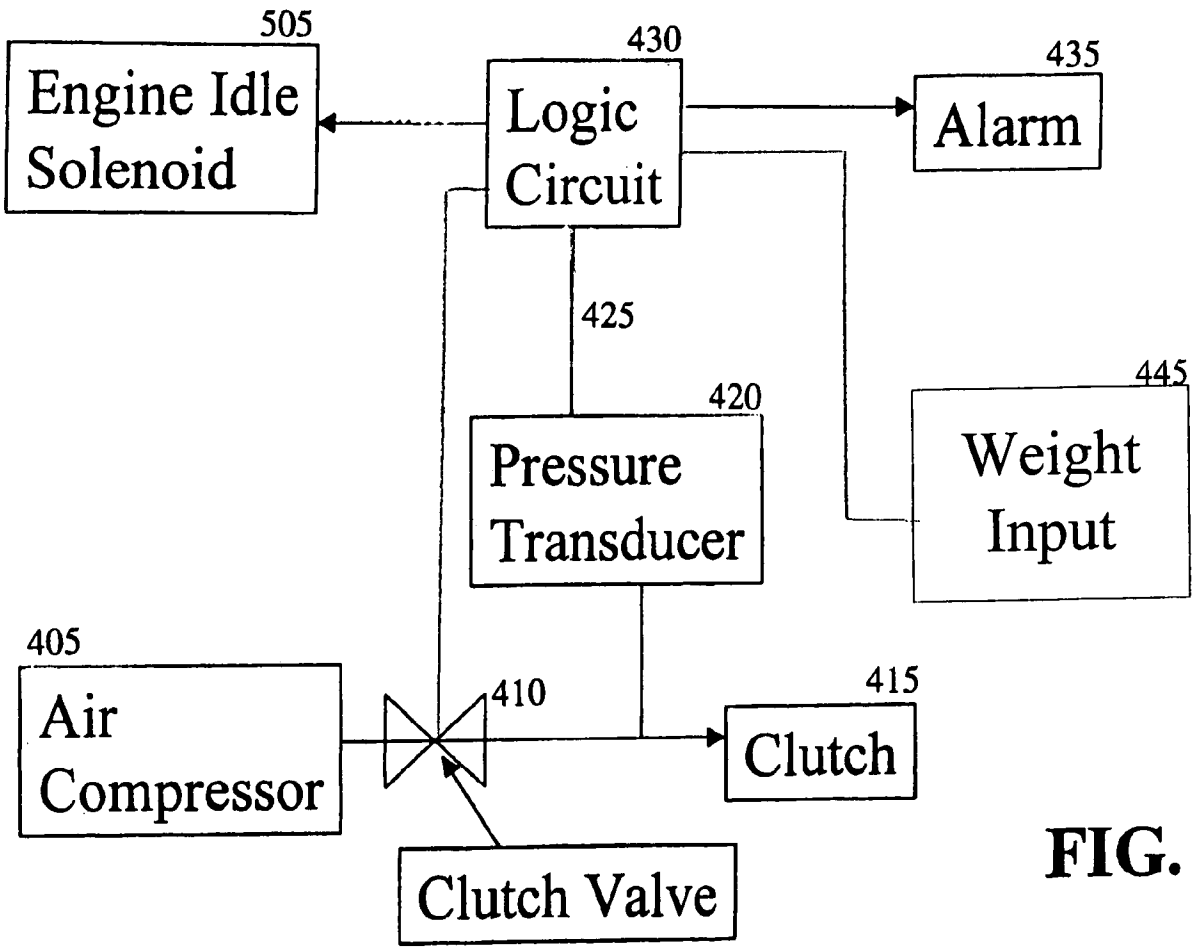
FIG. 5 shows a schematic of an alternative embodiment of the present invention.

In an alternative embodiment, as shown in FIG. 5. when the clutch air pressure is measured to be within the predetermined range (e.g. between 20 and 100 psi), the logic circuit 430 prohibits the operator from operating the hoist. In this embodiment, the logic circuit 430 sends an "engine idle" signal to an engine idle solenoid 505 that holds the engine in an idle state. In other words, when activated, the engine idle solenoid 505 prevents the operator from putting the engine in gear and operating the hoist by preventing the operator from increasing throttle to the engine. This embodiment provides further protection against the aforementioned unwanted clutch slippage.

In another alternative embodiment, the logic circuit 430 is capable of adjusting the predetermined pressure range based on the measured weight the well service rig 20 is handling. For instance, if a rig 2O is handling a light load or when the rig 20 is handling no load at all, the clutch 415 would not need full air pressure, nor would the clutch bladder 8 need to be fully inflated. Therefore, the logic circuit 430 must take a weight input 445 from the rig weight sensor 92 so as to determine the weight the rig 20 is supporting, and then can adjust the predetermined pressure range accordingly.

For example, when lifting heavy loads (e.g. 50,000 lbs or greater), the logic circuit would maximize the top end of the pressure range. Using the range example used throughout this specification, the logic circuit could increase the upper end to 110 psi, thereby making the monitored pressure range 20-110 psi. When lifting lighter loads (e.g. less than 30,000 lbs), the logic pressure might reduce the upper end of the pressure range to 80 psi, allowing for full engine throttle and 80 psi without warning the operator or preventing the clutch from engaging. When lifting intermediate loads (e.g. 30,000 lbs to 50,000 lbs), the logic circuit would use the original predetermined range of 20-100 psi. Of course the ranges given herein are used for example purposes only, as it is well within the ordinary skill of one in the art to determine the appropriate clutch pressure ranges for the specific clutch in use, as well as to determine the weight of light, intermediate, and heavy loads.

Although the invention is described with respect to several embodiments, modifications thereto will be apparent to those skilled in the art. For example, while the embodiments disclosed herein pertain to a mobile well service rig, this invention is equally applicable to the operation of a stationary oil drilling rig, and it is well within the skill of the art to adapt the described embodiments to an oil drilling rig. Therefore, the scope of the invention is to be determined by reference to the claims which follow.

What is claimed is:

1. An apparatus for monitoring air pressure on a rig clutch comprising:

a) a pressure transducer for measuring the air pressure applied to the clutch, b) a logic circuit for monitoring the measured air pressure and comparing the measured air pressure to a predetermined pressure range; and c) a weight sensor for measuring the weight supported by the rig, wherein the predetermined pressure range is programmed into the logic circuit based on a predetermined range of weight supported by the rig.

2. The apparatus of claim 1, further comprising a means for the logic circuit to notify a rig operator when the measured air pressure falls within the predetermined pressure range.

3. The apparatus of claim 2, wherein the means for notifying the rig operator wherein the measured air pressure falls within the predetermined pressure range is selected from the group consisting of activating an audible alarm or illuminating a light.

4. The apparatus of claim 1, further comprising a memory recording device, wherein the logic circuit records the monitored air pressure to the memory recording device.

5. The apparatus of claim 1, further comprising a memory recording device, wherein the logic circuit records a pulse signal to the memory recording device when the measured air pressure falls within the predetermined pressure range.

6. The apparatus of claim 1, further comprising a means for the logic circuit to prevent operation of the throttle when the measured air pressure falls within the predetermined pressure range.

7. The apparatus of claim 6, wherein the means for the logic circuit to prevent operation of the clutch is an engine idle solenoid.

8. The apparatus of claim 1, wherein the rig clutch is a well service rig clutch.

9. The apparatus of claim 1, wherein the rig clutch is an oil drilling rig clutch.

10. The apparatus of claim 1, wherein the logic circuit monitors the weight supported by the rig, and adjusts the predetermined pressure range based on the weight reading.

11. The apparatus of claim 10, wherein the logic circuit lowers an upper end of the predetermined pressure range when the weight supported by the rig is lower than a predetermined value.

12. The apparatus of claim 10, wherein the logic circuit raises an upper end of the predetermined pressure range when the weight supported by the rig is higher than a predetermined value.

13. A method for monitoring air pressure on a rig clutch comprising;

a) measuring the weight supported by a rig;

b) adjusting a predetermined pressure range based on the weight reading;

c) monitoring the air pressure applied to the clutch;

d) comparing the measured air pressure to the predetermined pressure range, and e) notifying a rig operator when the measured air pressure falls within the predetermined range.

14. The method of claim 13, wherein the means for notifying the rig operator is selected from the group consisting of activating an audible alarm or illuminating a light.

15. The method of claim 13, further comprising recording the monitored air pressure to a memory recording device.

16. The method of claim 13, further comprising recording a pulse signal to a memory recording device when the measured air pressure falls within the predetermined pressure range.

17. The method of claim 13, wherein a pressure transducer measures the air pressure applied to the clutch.

18. The method of claim 13, wherein a logic circuit compares the air pressure to the predetermined pressure range.

19. The method of claim 13, further comprising preventing the rig operator from operating the clutch when the measured air pressure falls within the predetermined pressure range.

20. The method of claim 13, further comprising lowering an upper end of the predetermined pressure range when the weight supported by the rig is lower than a predetermined value.

21. The method of claim 13, further comprising raising an upper end of the predetermined pressure range when the weight supported by the rig is higher than a predetermined value.

22. The method of claim 13, where the rig clutch is a well service rig clutch.

23. The method of claim 13, wherein the rig clutch is an oil drilling rig clutch.

24. An apparatus for monitoring air pressure on a rig clutch comprising:

a) a pressure transducer for measuring the air pressure applied to the clutch;

b) a logic circuit for monitoring the measured air pressure and comparing the measured air pressure to a predetermined pressure range; and c) an engine idle solenoid operable by the logic circuit to prevent operation of a throttle when the measured air pressure falls within the predetermined pressure range.

25. The apparatus of claim 24, further comprising a means for the logic circuit to notify a rig operator when the measured air pressure falls within the predetermined pressure range.

26. The apparatus of claim 24, further comprising a memory recording device, wherein the logic circuit records the monitored air pressure to the memory recording device.

27. The apparatus of claim 24, further comprising a memory recording device, wherein the logic circuit records a pulse signal to the memory recording device wherein the measured air pressure fails within the predetermined pressure range.

28. The apparatus of claim 24, further comprising a weight sensor for measuring the weight supported by the rig.

29. The apparatus of claim 28, wherein the predetermined pressure range is programmed into the logic circuit based on a predetermined range of weight supported by the rig.

30. The apparatus of claim 29, wherein the logic circuit monitors the weight supported by the rig, and adjusts the predetermined pressure range based on the weight reading.

31. The apparatus of claim 30, wherein the logic circuit lowers an upper end of the predetermined pressure range when the weight supported by the rig is lower than a predetermined value.

32. The apparatus of claim 30, wherein the logic circuit raises an upper end of the predetermined pressure range when the weight supported by the rig is higher than a predetermined value.

* * * * *